US005218152A

United States Patent [19]

Campbell et al.

[11] Patent Number: 5,218,152

[45] Date of Patent: Jun. 8, 1993

[54] DRUMSTICK BALANCED FOR JUGGLING

[76] Inventors: Francis W. Campbell, 38 Nickelhill La., Levittown, Pa. 19054; William R. Sands, III, 3 Birch Ct., Newtown, Pa. 18940

[21] Appl. No.: 714,274

[22] Filed: Jun. 12, 1991

[51] Int. Cl.[5] ..... G10D 13/00

[52] U.S. Cl. ..... 84/422.4

[58] Field of Search ..... 84/422.4; 272/124

[56] References Cited

U.S. PATENT DOCUMENTS

| | | | |
|---|---|---|---|
| 1,484,096 | 2/1924 | Van Horn | 84/422.4 |
| 2,521,336 | 9/1950 | Bramson | 84/422.4 |
| 3,165,964 | 11/1962 | Stys et al. | 84/422.4 |
| 3,301,119 | 1/1967 | Gilbert | 84/422.4 |
| 3,489,052 | 10/1967 | Colyer et al. | 84/422.4 |
| 4,385,544 | 5/1983 | Heiskell | 84/422.4 |
| 4,557,176 | 12/1985 | Boturla | 84/422.4 |
| 4,696,468 | 9/1987 | Dube | 272/124 |
| 4,719,836 | 1/1988 | Baumgart | 84/422.4 |
| 4,905,566 | 3/1990 | Hughlett et al. | 84/422.4 |

OTHER PUBLICATIONS

J. D. Calato Manufacturing Co. Inc. Catalog, Niagara Falls, N.Y., 1982, pp. 5 and 7.

Pro-Mark Catalog, Houston, Tex., Jun. 1983.

*Primary Examiner*—Michael L. Gellner

*Assistant Examiner*—Cassandra Spyrou

*Attorney, Agent, or Firm*—Thomas F. Lenihan

[57] ABSTRACT

In a first embodiment, a drumstick, balanced for juggling, exhibits a center of mass in the range of 58% to 62% of the distance along its length from the butt end. It is herein recognized that such a drumstick is suitable for both juggling and drumming, and supports a drumming performance which includes a juggling portion. In second and third embodiments, a drum mallet and a keyboard mallet, each of which is balanced for juggling, exhibits a center of mass in the range of 58% to 62% along the shaft from the butt end.

6 Claims, 3 Drawing Sheets

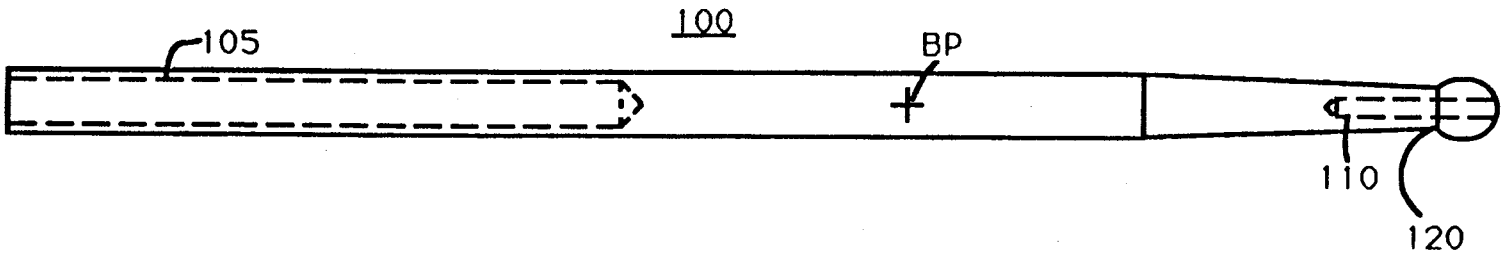
Fig. 1a
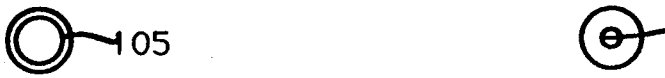
Fig. 1b
Fig. 1c
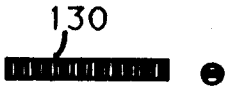
Fig. 1d

DRUMSTICK BALANCED FOR JUGGLING

FIELD OF THE INVENTION

The subject application generally concerns the field of drumsticks and similar percussion implements, and specifically concerns a drumstick, or the like, balanced for juggling.

BACKGROUND OF THE INVENTION

The performances of modern drummers have become more and more showmanlike. During these performances, it is not unusual for a drummer to twirl his drumsticks from time to time. One might think that a natural extension of a drummer's tendency to twirl the sticks would be actual juggling of the sticks during the drumming performance. Unfortunately, juggling devices (i.e., juggling props, such as juggling clubs and torches) and drumsticks are balanced very differently.

For purposes of this discussion, the following terms are used interchangeably and are assumed to have the same meaning: center of mass, center of balance, center of gravity, and balance point. A juggling club having a center of mass located approximately 60% of the distance along the length of the club from the handle end, is the American model juggling club manufactured by Tod Smith Products, Cleveland, OH.

Conversely, it is well known that drumsticks are balanced to exhibit a center of mass in the range of 35% to 57.3% of the distance along the length of the stick from the butt end. For example, U.S. Pat. No. 4,905,566 (Hughlett, et al.) discloses a drumstick balanced in the range of 35% to 41% of the distance from the butt end.

Hughlett, et al. also cites the following:

U.S. Pat. No. 3,301,119 (Gilbert) which discloses a balance point in the range from 42% to 57.3%;

U.S. Pat. No. 3,165,964 which discloses that "Drummers are accustomed to the weight of wooden drumsticks and find that drumsticks which deviate from this weight for a given size are seriously objectionable", (See column 2, line 33); and U.S. Pat. No. 4,385,544 (Heiskell) which discloses a drumstick made of rolled, impregnated fabric, and having a center of gravity in the range of 43.75% to 46.875% of the distance from the butt end.

SUMMARY OF THE INVENTION

In a first embodiment, a drumstick, balanced for juggling, exhibits a center of mass in the range of 58% to 62% of the distance along its length from the butt end. It is herein recognized that such a drumstick is suitable for both juggling and drumming, and supports a drumming performance which includes a juggling portion. In second and third embodiments, a drum mallet and a keyboard mallet, each of which is balanced for juggling, exhibits a center of mass in the range of 58% to 62% along the shaft from the butt end.

BRIEF DESCRIPTION OF THE DRAWING

FIGS. 1*a*–1*d* show a drumstick incorporating the subject invention.

DETAILED DESCRIPTION OF THE EMBODIMENT

Figure 2A:
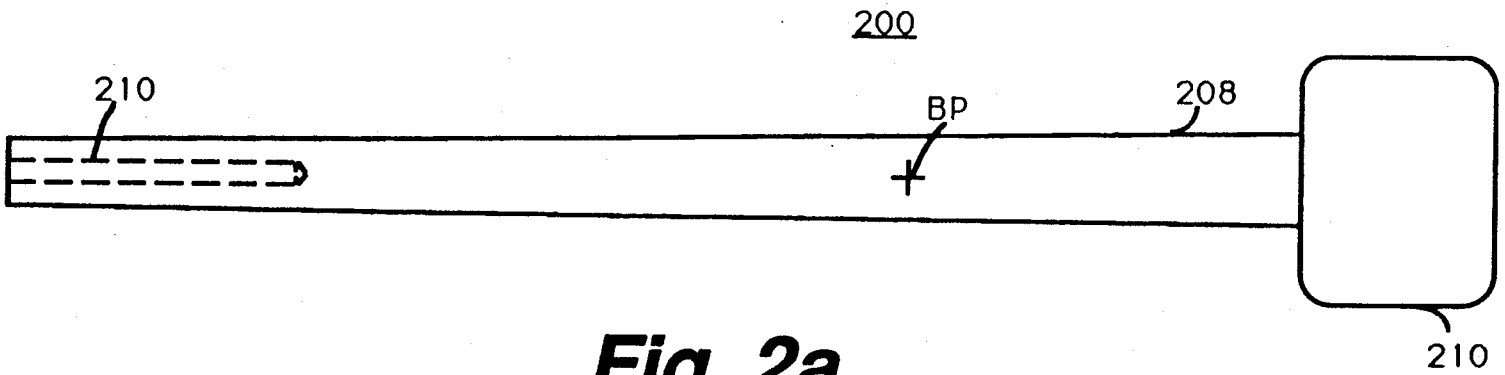
FIGS. 2*a*–2*c* show a drum mallet incorporating the subject invention.

Referring to FIG. 1*a*, a drumstick generally designated 100, provides in accordance with the subject invention a balance point located at 60% of the distance along its length from the butt end. This balance point was selected in order to obtain the same "feel" as that of a juggling club, which typically exhibits a balance point (i.e. center of gravity or center of mass) in the range of 58% to 62% of the distance from the handle end. The dimensions and balance point of the above-noted "American" model juggling club were measured and scaled proportionately to arrive at optimum characteristics for a drumstick suitable for juggling. The proportion used to determine the balance point (b.p.) of the stick used was:

$$\text{b.p. of stick} = (\text{b.p. of club}/\text{length of club}) \times \text{length of stick}$$

Of course, in actual manufacturing practice, one would start with a wooden "blank" when fabricating a drumstick. However, for development of the subject invention, the starting point was a commercially available heavy wooden marching stick, Model DC-9 manufactured by PROMARK of Houston, TX. As noted above, drumsticks are intentionally designed to be "back heavy". Thus, the first step in the process was to remove mass from the back of the DC-9 stick by cutting off one-half inch from the butt end of the stick. This reduced the overall length to from 16.250 inches to 15.750 inches and shifted the center of mass slightly forward. The next step was to remove additional mass from the rear of the stick by drilling a one-half inch diameter hole 105 to a depth of 6.50 inches along the main axis of the stick as shown in FIG. 1*b*.

While this drilling process removed mass and thereby shifted the center of mass forward, it was found that the forward displacement of the center of mass was insufficient. Clearly, mass had to be added to the front end of the stick to cause the balance point to be correctly positioned in the desired range from 58% to 62% of the distance from the butt end. It is noted in passing that juggling clubs naturally exhibit a balance point positioned forward along the handle because juggling clubs are bulbous at the front end, rather than being narrower as are drumsticks.

Since one of the design objectives is to maintain the appearance and functionality of a normal drumstick, such measures as adding a metal collar to the front end of the stick are clearly undesirable. It was therefore decided to drill a 1.75 inch deep hole 110 at the "bead end" of the stick for insertion of a number 10 brass screw stud as shown in FIG. 1*c*. Brass screw stud 130 of FIG. 1*d* weighs 4.70 grams and is sufficient to shift the center of mass to the proper point as shown in FIG. 1*a*.

Hole 110 was then tapped with 10–24 threads, glue was applied to the threads of 10–24 screw stud 130 and the screw stud was inserted. The glue tends to lock screw stud 130 in place so that it does not become dislodged during a performance. The number 10 screw stud dimension was chosen as the maximum hole size so as not to excessively weaken the drumstick at the "neck" portion 120 which is the narrowest part of the stick, and which is subjected to a great amount of stress due to repeated forceful impacts during a drumming performance.

In drumming use, it was found, as expected, that sticks according to the invention exhibit less than optimum rebound characteristics due to the more forward placement of the balance point. However, it was also found that they are still quite usable for playing. In fact, the subject drumsticks have been found to be good "practice" or "training" sticks for building wrist speed in drum students, because the student must compensate for the reduced rebound characteristics by using additional stick control.

In juggling use, several advantages have been noted. First, the sticks have substantially identical balance characteristics with respect to juggling clubs. Thus, it has been found that juggling students have little or no difficulty in switching from the juggling of the subject sticks to the juggling of clubs, because the "feel" is substantially the same.

Second, the subject sticks are shorter than juggling clubs (i.e. 15.750 inches versus 20 inches). This allows the juggler to juggle within a smaller physical area, known as the juggling "window". The window for juggling clubs is initially large when the juggler begins juggling, and decreases as the juggler gains control of the clubs, and as he increases the rotational speed of the clubs. The initial window for clubs is approximately 5 feet high by 3½ feet wide. The width of the juggling window is affected by the diameter of the head of the juggling clubs because the clubs must have room to pass each other in flight. In contrast, as noted above, the drumsticks of the subject invention allow for a window of reduced size, approximately 2.5 feet high by 1.5 feet wide. That is, the shorter drumsticks turn about the center of mass in a smaller area than do the longer juggling clubs, while the enter of mass follows a similar, but smaller, simple parabolic curve. Advantageously, this allows the juggler to practice indoors in rooms having normal 8 foot-high ceilings. A further advantage is that the small diameter of the drumsticks allows the window width to be reduced to less than half that required for juggling clubs.

Third, juggling clubs generally have prices in the range of $18 to $35 per club, or $54 to $105 per set of three. It is expected that this drumsticks of the subject invention will be available for approximately ⅓ of that cost. This should make the art of juggling more available to children, in that their parents may be more willing to invest the lesser amount of money to see if the child will persist in the endeavor.

Figure 4:
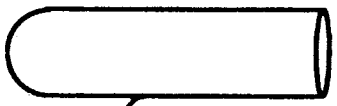
FIG. 4 shows a heat-shrinkable end cap suitable for use with the invention as shown in FIGS. 1*a*, 2*a*, and 3*a*.

During testing of the sticks it was found that stress fractures occurred at the hollowed out butt end. This problem was overcome by applying a heat-shrinkable polyolefen sleeve 400 of FIG. 4, such as ALPHA-CAP 25, listed in the ALPHA WIRE catalog on page 236, published by ALPHA WIRE Co., Elizabeth, NJ, to the outside of the butt end, and shrinking it tight by applying heat from a heat gun. After sleeve 400 is shrunk, it provides a constricting force around the butt end of the stick (i.e., a compression of the outer circumference). No stress fractures were found in sticks which were modified in this way. The addition of heat shrinkable sleeve 400 did not materially alter the center of mass of the stick.

Figure 2B:
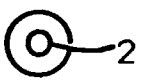
Figure 2C:
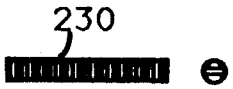

FIG. 2*a* shows a drum mallet, generally designated 200, having a shaft 208 and a head 220 and having a balance point in accordance with the invention. In this embodiment, the head 220 causes the balance point to be too far forward. In such a case, a brass weight such as a ¼-20 brass screw stud of a sufficient length may be added to the butt end to bring the balance point within the correct range of 58% to 62% of the distance from the butt end of the mallet. Such a brass ¼-20 screw stud 230 is shown in FIG. 2*c*. Preferable it is screwed into a drilled and tapped hole 210 formed in the butt end of the mallet.

The mass needed to correctly reposition the center of mass (balance point) of a drum mallet is determined in accordance with the characteristics of the particular drum mallet or keyboard mallet chosen. Thus, the depth of hole 210 and the length of brass stud 230 of FIG. 2*c* are labeled "AS NEEDED". One skilled in the art will realize that the weight of the screw stud is directly proportional to the length of the stud and that the proper weight is that which will locate the balance point of the mallet between 58% and 62% of the distance along its handle from the butt end.

It is also noted that the center of balance may be correctly repositioned by fabricating the shaft with a flared or slightly bulbous butt end, rather than by adding a separate weight. Alternatively, the center of balance also may be correctly repositioned by removing material from the head end It is noted that materials other than brass (such as steel or lead) are also siutable for providing the additional mass of repositioning the center of mass of the stick, or mallet.

Figure 3A:
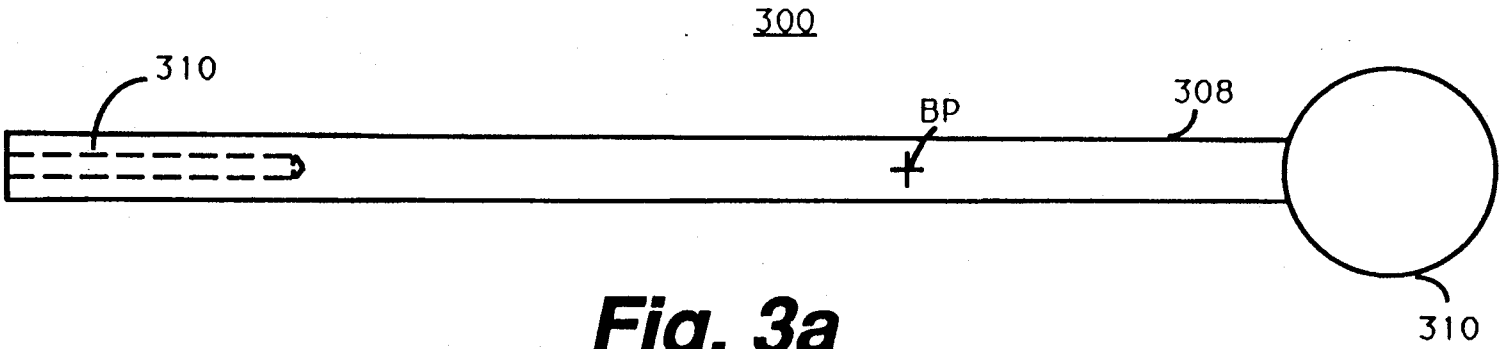
FIGS. 3*a*–3*c* show a keyboard mallet incorporating the subject invention.
Figure 3B:
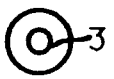
Figure 3C:
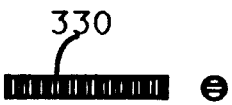

A keyboard mallet in accordance with the invention is shown in FIG. 3*a*. The elements of FIGS. 3*a*, 3*b*, and 3*c* are substantially the same as those of FIGS. 2*a*, 2*b*, and 2*c* and need not be described in detail again.

Thus, there has been described a drumstick or mallet, balanced for juggling and useful for drumming, which substantially retains its overall appearance as a normal drumstick or mallet. It is herein recognized that such sticks or mallets may be fabricated from wood or from synthetic materials so long as the balance point is located within the acceptable range of 58% to 62% of the distance from the butt end.

What is claimed is:

1. A drumstick, comprising:

a shaft having a butt end and a striking tip at a second end;

said shaft from said butt end to said striking tip inclusive, being a single continuous piece of wood;

said drumstick having a center of mass located within a predetermined range of distances from said butt end;

said predetermined range of distances having lower and upper limits, said lower limit being greater than 58% of the distance from said butt end, said upper limit being 62% of the distance from said butt end;

said butt end includes a hollowed out portion, and said second end having said striking tip includes a hollowed out portion, said hollowed out portion of said striking tip having a metal weight inserted therein, said metal weight being sufficient to balance said drumstick within said predetermined range of distances from said butt end.

2. The drumstick of claim 1, wherein said metal weight is a lead weight.

3. The drumstick of claim 1, wherein said metal weight is a steel weight.

4. The drumstick of claim 1, wherein said butt end of said drumstick incorporating said hollowed out portion is generally cylindrical and exhibits an inner circumference and an outer circumference, said drumstick further comprising means for compressing said outer circumference of said butt end of said shaft.

5. A drumstick, comprising:

a shaft having a butt end and a striking tip at a second end;

said drumstick having a center of mass located within a range of distances from said butt end;

said range of distances having lower and upper limits, said lower limit being greater than 58% of the distance from said butt end, said upper limit being 62% of the distance from said butt end;

said butt end comprising a hollowed out portion, and said second end having said striking tip including a weight sufficient to balance said drumstick within said range of distances from said butt end:

said drumstick being made of a single continuous piece of wood from said butt end to said striking tip inclusive; and wherein said weight is brass.

6. A drumstick, comprising:

a shaft having a butt end and a striking tip at a second end;

said drumstick having a center of mass located within a range of distances from said butt end;

said range of distances having lower and upper limits, said lower limit being greater than 58% of the distance from said butt end, said upper limit being 62% of the distance from said butt end;

said butt end comprising a hollowed out portion, and said second end having said striking tip including a weight sufficient to balance said drumstick within said range of distances from said butt end;

said drumstick being made of wood, and said weight being brass; and said weight comprising screw threads and means for receiving a tool for driving said threaded weight into said second end of said drumstick.

* * * * *